US011517932B2

(12) United States Patent
Tanaka

(10) Patent No.: US 11,517,932 B2
(45) Date of Patent: Dec. 6, 2022

(54) FOUNTAIN APPARATUS

(71) Applicant: Tsurumi Manufacturing Co., Ltd., Osaka (JP)

(72) Inventor: Shizuo Tanaka, Yawata (JP)

(73) Assignee: Tsurumi Manufacturing Co., Ltd., Osaka (JP)

( * ) Notice: Subject to any disclaimer, the term of this patent is extended or adjusted under 35 U.S.C. 154(b) by 196 days.

(21) Appl. No.: 16/966,641

(22) PCT Filed: Apr. 12, 2019

(86) PCT No.: PCT/JP2019/016041
§ 371 (c)(1),
(2) Date: Jul. 31, 2020

(87) PCT Pub. No.: WO2019/216123
PCT Pub. Date: Nov. 14, 2019

(65) Prior Publication Data

US 2020/0360961 A1 Nov. 19, 2020

(30) Foreign Application Priority Data

May 9, 2018 (JP) ..... JP2018-090842

(51) Int. Cl.
*B05B 17/08* (2006.01)
*B05B 3/06* (2006.01)

(52) U.S. Cl.
CPC ..... *B05B 17/08* (2013.01); *B05B 3/06* (2013.01)

(58) Field of Classification Search
CPC ..... B05B 17/08; B05B 3/06
USPC ..... 239/16–23, 251, 261, 262, 264
See application file for complete search history.

(56) References Cited

FOREIGN PATENT DOCUMENTS

| | | | |
|---|---|---|---|
| EP | 1 666 162 | A1 | 6/2006 |
| JP | 55-174970 | U | 12/1980 |
| JP | 2-56300 | A | 2/1990 |
| JP | 4-81675 | U | 7/1992 |
| JP | 5-68921 | A | 3/1993 |
| JP | 6-60497 | U | 8/1994 |
| JP | 8-108198 | A | 4/1996 |
| JP | 9-314176 | A | 12/1997 |
| JP | 3047163 | U | 3/1998 |
| JP | 2001-347196 | A | 12/2001 |
| JP | 2012-130869 | A | 7/2012 |

OTHER PUBLICATIONS

Japanese-language Notice of Reasons for Refusal issued in Japanese Application No. 2018-090842 dated Jun. 22, 2021 with English translation (4 pages).

(Continued)

*Primary Examiner* — Christopher S Kim
(74) *Attorney, Agent, or Firm* — Crowell & Moring LLP

(57) ABSTRACT

A fountain apparatus (100) includes a submersible pump (1), a water supply pipe (2) including one end connected to a discharge port (13*b*) of the submersible pump (1), a rotating mechanism (5) including a rotating shaft (51) and a water jet nozzle (50) configured to jet water supplied through the water supply pipe (2), and a support mechanism (4) provided at the other end of the water supply pipe (2) and configured to rotatably support the rotating mechanism (5) via the rotating shaft (51). The water jet nozzle (50) includes a first jet nozzle (53) configured to jet the water in a jetting direction having a propulsive force component in a circumferential direction of the rotating shaft (51).

10 Claims, 3 Drawing Sheets

(56) References Cited

OTHER PUBLICATIONS

Supplementary European Search Report issued in European Application No. 19800147.1 dated Jun. 1, 2021 (eight (8) pages).
International Search Report (PCT/ISA/210) issued in PCT Application No. PCT/JP2019/016041 dated May 21, 2019 with English translation (five pages).
Japanese-language Written Opinion (PCT/ISA/237) issued in PCT Application No. PCT/JP2019/016041 dated May 21, 2019 (three pages).

500-500 SECTION

FOUNTAIN APPARATUS

TECHNICAL FIELD

The present invention relates to a fountain apparatus, and more particularly, it relates to a fountain apparatus including rotating water jet nozzles.

BACKGROUND ART

In general, a fountain apparatus including rotating water jet nozzles is known. Such a fountain apparatus is disclosed in Japanese Patent Laid-Open No. 5-068921, for example.

Japanese Patent Laid-Open No. 5-068921 discloses a fountain apparatus including a submersible pump, a fountain nozzle, a motor, and a tubular rotating shaft with which the fountain nozzle is attached and that supplies water from the submersible pump to the fountain nozzle. The motor functions as a drive that rotationally drives the rotating shaft. The motor is configured to rotate the rotating shaft via a plurality of gears. The rotating shaft is configured to rotate the fountain nozzle by being rotated by the motor.

PRIOR ART

Patent Document

Patent Document 1: Japanese Patent Laid-Open No. 5-068921

SUMMARY OF THE INVENTION

Problems to be Solved by the Invention

However, the fountain apparatus described in Japanese Patent Laid-Open No. 5-068921 needs to include the motor as a drive and the plurality of gears in order to rotate the fountain nozzle, and the number of components disadvantageously increases. Therefore, there are problems that the size of the fountain apparatus increases and the apparatus structure becomes complicated.

The present invention has been proposed in order to solve the aforementioned problems, and an object of the present invention is to provide a fountain apparatus in which an increase in its size can be significantly reduced or prevented, and its complicated structure can be significantly reduced or prevented.

Means for Solving the Problem

In order to attain the aforementioned object, a fountain apparatus according to an aspect of the present invention includes a submersible pump, a water supply pipe including one end connected to a discharge port of the submersible pump, a rotating mechanism including a rotating shaft and a water jet nozzle configured to jet water supplied through the water supply pipe, and a support mechanism provided at the other end of the water supply pipe and configured to rotatably support the rotating mechanism via the rotating shaft. The water jet nozzle includes a first jet nozzle configured to jet the water in a jetting direction having a propulsive force component in a circumferential direction of the rotating shaft.

In the fountain apparatus according to this aspect of the present invention, as described above, the first jet nozzle jets the water in the jetting direction having the propulsive force component in the circumferential direction of the rotating shaft such that a rotational force can be applied to the rotating mechanism. That is, the water can be jetted while the rotating mechanism is rotated without providing a dedicated drive mechanism for rotating the rotating mechanism in addition to the submersible pump that supplies water to the rotating mechanism in the fountain apparatus. Therefore, it is not necessary to provide a motor and a plurality of gears as a drive that rotates the rotating mechanism as in the prior art, and thus an increase in the number of components can be significantly reduced or prevented. Consequently, an increase in the size of the apparatus can be significantly reduced or prevented, and the complicated apparatus structure can be significantly reduced or prevented.

In the aforementioned fountain apparatus according to this aspect, the first jet nozzle preferably includes a plurality of first jet nozzles, and the plurality of first jet nozzles are preferably arranged at substantially equal angular intervals in the circumferential direction of the rotating shaft. According to this structure, a rotational force can be applied to the rotating mechanism in a balanced manner by the plurality of first jet nozzles, and thus the rotating mechanism can be stably rotated.

In the aforementioned fountain apparatus according to this aspect, the water jet nozzle preferably further includes a second jet nozzle configured to jet the water in a jetting direction having no propulsive force component in the circumferential direction of the rotating shaft. According to this structure, the water can be jetted in the different jetting direction from that of the first jet nozzle by the second jet nozzle, and thus the water can be jetted in more various directions, unlike the case in which the water is jetted only from the first jet nozzle. That is, the shape of the jetted water can be changed from a monotonous shape to a more complicated shape. Consequently, when the fountain apparatus is used for ornamental purposes, a preferable water shape can be obtained for ornamental purposes. In addition, the second jet nozzle is provided separately from the first jet nozzle that jet the water having the propulsive force component in the circumferential direction of the rotating shaft such that the water can be jetted in various directions while an excessive increase in a rotational force acting on the rotating mechanism is significantly reduced or prevented.

The aforementioned fountain apparatus according to this aspect preferably further includes a float that surrounds the water supply pipe. According to this structure, unlike the case in which the fountain apparatus is fixed to the bottom surface of a place in which water is stored, the fountain apparatus can be easily installed at a predetermined height position with respect to the water surface by the float. Moreover, the fountain apparatus can be easily installed in various places in which water is stored.

In this case, the submersible pump is preferably disposed on a rotation center axis of the rotating shaft. According to this structure, the position of the center of gravity of the submersible pump having a relatively heavy weight can be located directly below the float, and thus the submersible pump can be stably supported by the float. Consequently, tilting of the fountain apparatus floated by the float can be significantly reduced or prevented.

In the aforementioned fountain apparatus according to this aspect, the first jet nozzle is preferably inclined at an angle of less than 180 degrees with respect to a normal of a circle that extends in the circumferential direction of the rotating shaft in a plan view. According to this structure, even when the motor rotates in a direction opposite to that of the rotating shaft due to a reaction force generated by rotation of the pump rotating shaft 11*a* (impeller) of the submersible pump, a propulsive force can be applied by rotating the rotating mechanism in a direction to counteract the force generated by rotation of the motor. Thus, movement of the submersible pump (fountain apparatus) due to the force generated by rotation of the motor can be prevented, and the flying shape of the water jetted from the first jet nozzle can be unique with a stronger twist.

In the aforementioned fountain apparatus according to this aspect, a gap is preferably provided between the water supply pipe and the rotating mechanism, and the water is preferably jetted from the gap. According to this structure, it is not necessary to provide a seal member generally provided between the water supply pipe and the rotating mechanism, and thus the complicated apparatus structure can be further significantly reduced or prevented. Furthermore, there is no mechanical sliding, and thus stable rotation can be maintained as compared with the case in which a seal member or the like is provided. Moreover, the water can be jetted in the different jetting direction from that of the first jet nozzle, and thus unlike the case in which the water is jetted only from the first jet nozzle, the water can be jetted in more various directions. Consequently, when the fountain apparatus is used for ornamental purposes, a preferable water shape can be obtained for ornamental purposes.

In this case, the rotating mechanism preferably further includes a pipe including a tip at which the water jet nozzle is provided, and a rotating member connected to the pipe and configured to rotate together with the rotating shaft, the water supply pipe preferably includes an annular side wall including an opening on an upper side, and the side wall is preferably disposed below the rotating member such that the opening is substantially covered by the rotating member, and preferably includes an upper end spaced apart from the rotating member by the gap that is annular. According to this structure, the water jetted from the annular gap can be jetted annularly and substantially evenly in the circumferential direction of the rotating shaft.

In the aforementioned fountain apparatus according to this aspect, the first jet nozzle is preferably configured to jet the water in a jetting direction having an upward component. According to this structure, interference of the water jetted from between the water supply pipe and the rotating mechanism with the first jet nozzle can be prevented. Moreover, the water can be jetted upward from the first jet nozzle, and thus the jetted water can be more easily visually recognized and can reach a wider range.

In the aforementioned structure in which the gap from which the water is jetted is provided between the water supply pipe and the rotating mechanism, the side wall preferably includes a funnel-shaped water guide jet that surrounds a periphery of the rotating member, the funnel-shaped water guide jet being configured to guide water that has passed through the gap obliquely upward and jet the water. According to this structure, the funnel-shaped water guide jet can adjust the flow direction of the water that passes therethrough, and thus the jetting direction of the water to be jetted can be adjusted.

In this case, the rotating member preferably includes an inclined surface that faces an inner surface of the funnel-shaped water guide jet, and a water guide channel configured to guide the water that has passed through the gap is formed between the inner surface of the funnel-shaped water guide jet and the inclined surface. According to this structure, the water guide channel can further adjust the flow direction of the water that passes therethrough, and thus the jetting direction of the water to be jetted can be further adjusted. Consequently, a unique water shape preferred for ornamental purposes can be obtained. That is, the shape of the water jetted through the water guide channel can be generally made into a dish shape (dish edge shape).

Effect of the Invention

According to the present invention, as described above, an increase in the size of the apparatus can be significantly reduced or prevented, and the complicated apparatus structure can be significantly reduced or prevented.

MODES FOR CARRYING OUT THE INVENTION

An embodiment of the present invention is hereinafter described on the basis of the drawings.

(Structure of Fountain Apparatus)

Figure 1:
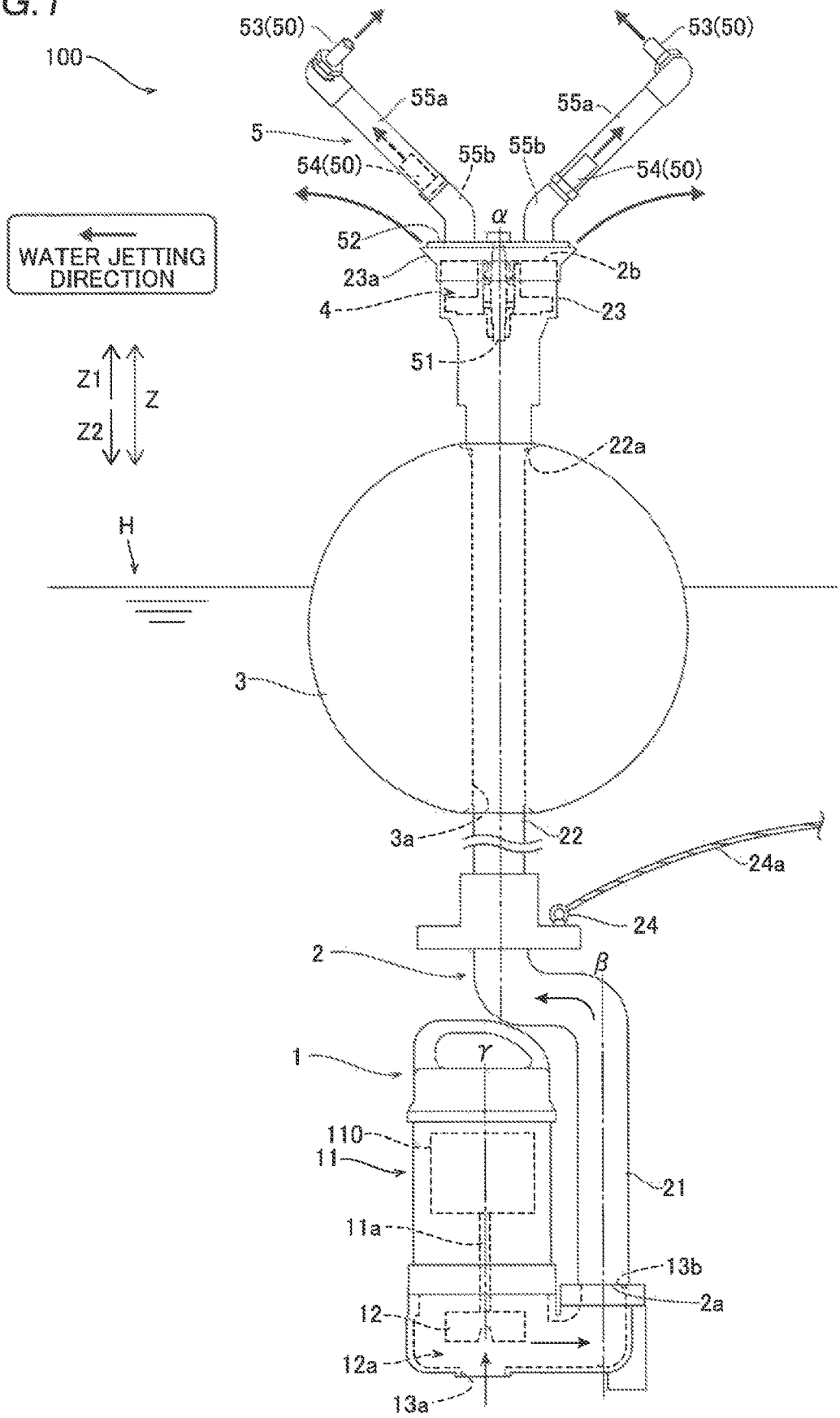
FIG. 1 A schematic view showing a fountain apparatus according to an embodiment of the present invention.

The embodiment of the present invention is now described with reference to FIGS. 1 to 3. The fountain apparatus 100 according to the present embodiment shown in FIG. 1 is installed in a floating state in a water storage area H such as a pond. The fountain apparatus 100 is used for the purpose of improving the water quality of the water storage area H or for ornamental purposes, for example.

The fountain apparatus 100 includes a submersible pump 1, a water supply pipe 2, a float 3, a support mechanism 4, and a rotating mechanism 5.

The fountain apparatus 100 is configured to send water in the water storage area H pumped by the submersible pump 1 to the rotating mechanism 5 through the water supply pipe 2 and to jet the water from the rotating mechanism 5. The rotating mechanism 5 is rotatably supported by the support mechanism 4 and is configured to jet water while rotating.

Figure 2:
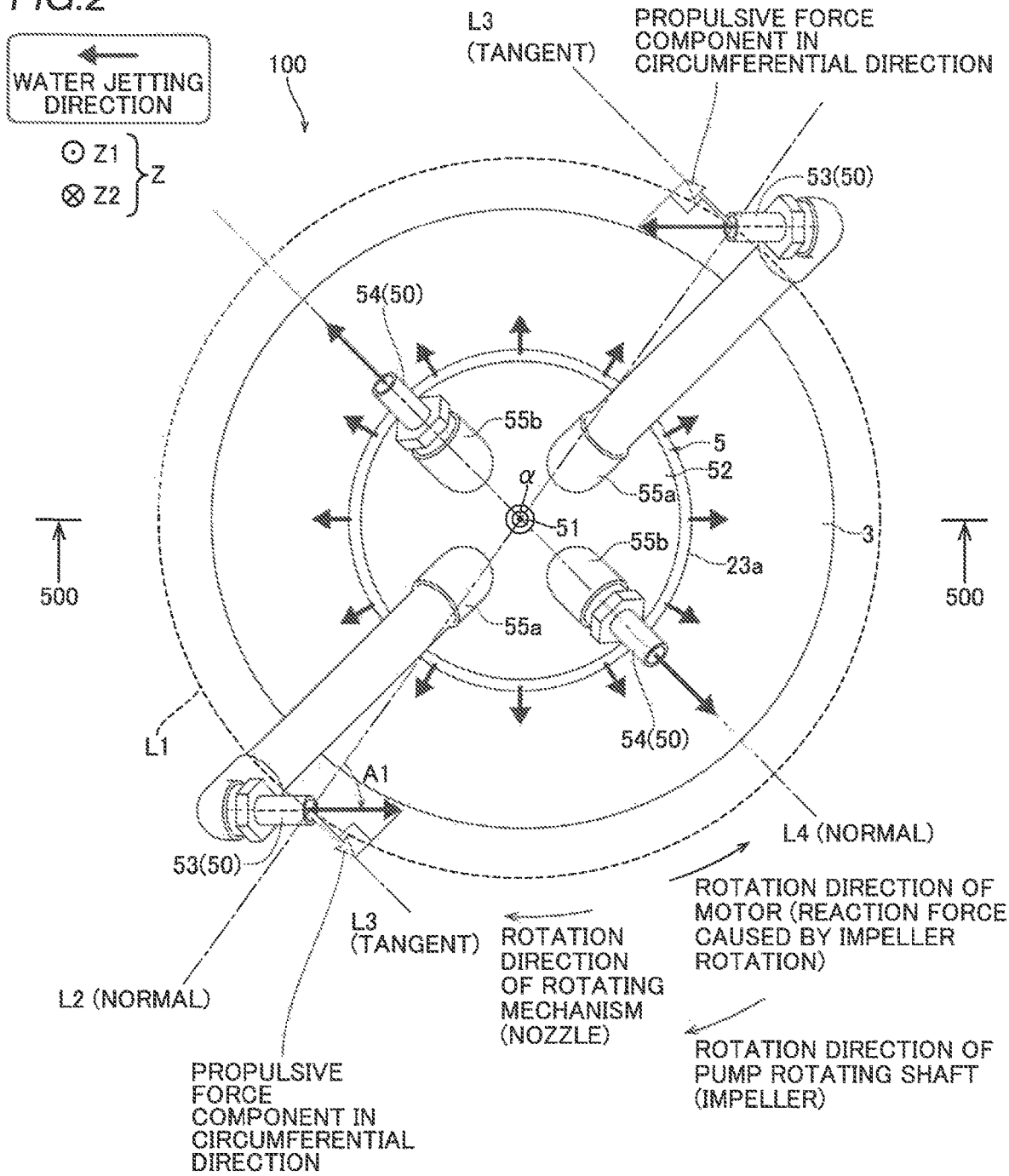
FIG. 2 A plan view showing the fountain apparatus according to the embodiment of the present invention.

As shown in FIG. 2, the fountain apparatus 100 is configured to jet water while rotating the rotating mechanism 5 by jetting the water in a jetting direction having a propulsive force component in the circumferential direction (tangential direction) of a rotating shaft 51 from water jet nozzles 50 (first jet nozzles 53) described below. The details are described below.

<Structure of Submersible Pump>

As shown in FIG. 1, the submersible pump 1 is a vertical submersible electric pump in which a pump rotating shaft 11*a* extends in a Z direction. The submersible pump 1 is installed in a state in which its entirety is submerged in the water in the water storage area H and is floated (separated) from the bottom surface of the water storage area H. The submersible pump 1 includes the pump rotating shaft 11*a*, a motor 11 including a stator/rotor 110, and an impeller 12. A pump chamber 12*a* in which the impeller 12 is disposed is disposed at the lower end of the submersible pump 1. The submersible pump 1 is provided with a suction port 13*a* on the lower side (Z2 direction side) of the impeller 12 (pump chamber 12*a*). Furthermore, the submersible pump 1 is provided with a discharge port 13*b* on the lateral side of the impeller 12 (pump chamber 12*a*).

The submersible pump 1 is disposed on the rotation center axis a of the rotating shaft 51 (described below) of the rotating mechanism 5. The pump rotating shaft 11*a* of the submersible pump 1 extends in a direction substantially parallel to the rotation center axis a of the rotating shaft 51.

<Structure of Water Supply Pipe>

As shown in FIG. 1, the water supply pipe 2 is a pipe member that functions as a path through which water discharged from the discharge port 13*b* of the submersible pump 1 is sent to the rotating mechanism 5. One end 2*a* of the water supply pipe 2 is connected to the discharge port 13*b* of the submersible pump 1, and the support mechanism 4 is provided at the other end 2*b* thereof.

Specifically, the water supply pipe 2 includes a first pipe 21, a second pipe 22 disposed on the downstream side of the first pipe 21, and a side wall 23. The first pipe 21 extends upward (in a Z1 direction) along the outer shape of the submersible pump 1 from the lower end (one end 2*a*) connected to the discharge port 13*b*, and has an L-shape that curves inward toward directly above the submersible pump 1 on the upper side of the submersible pump 1. The second pipe 22 is disposed directly above the submersible pump 1 and has a linear shape that extends in the Z direction. The center axis of the second pipe 22 is disposed on the rotation center axis a of the rotating shaft 51.

A mooring 24 is provided in the vicinity of the lower end of the second pipe 22. A mooring rope 24*a* is tied to the mooring 24. Thus, drifting of the fountain apparatus 100 including the submersible pump 1 can be significantly reduced or prevented.

In the vicinity of the upper end of the second pipe 22, a step 22*a* in which the horizontal width of the pipe increases upward is provided. The horizontal size of a lower portion of the step 22*a* of the second pipe 22 is smaller than that of a through-hole 3*a* (described below) of the float 3, and the horizontal side of an upper portion of the step 22*a* of the second pipe 22 is larger than that of the through-hole 3*a* (described below) of the float 3. The step 22*a* is configured to come into contact with the float 3 through which the second pipe 22 is inserted from above to restrict upward movement of the float 3 with respect to the second pipe 22. Thus, the step 22*a* locates the height position of the water supply pipe 2 with respect to the float 3 (water surface).

The side wall 23 is provided at the upper end of the second pipe 22. The side wall 23 is annular (cylindrical) so as to have an opening 230 on the upper side. The side wall 23 is disposed below a rotating member 52 (described below) of the rotating mechanism 5 such that the opening 230 is substantially covered by the rotating member 52. The side wall 23 is disposed in such a manner that the upper end (the other end 2*b*) is spaced apart from the rotating member 52 by an annular gap S.

<Structure of Float>

As shown in FIG. 1, the float 3 is provided to float and support the submersible pump 1. The float 3 generally has a spherical shape. The float 3 includes the through-hole 3*a* that penetrates in the Z direction near its horizontal center, and the second pipe 22 (water supply pipe 2) is inserted through the through hole 3*a*. That is, the float 3 surrounds the second pipe 22 (water supply pipe 2). As described above, the float 3 comes into contact with the step 22*a* of the second pipe 22 from below. The float 3 is made of a foam material or a hollow member.

The float 3 is provided below (directly below) the rotating mechanism 5. That is, the float 3 allows the rotating mechanism 5, which jets water, to be located above the water surface.

<Structure of Support Mechanism>

Figure 3:
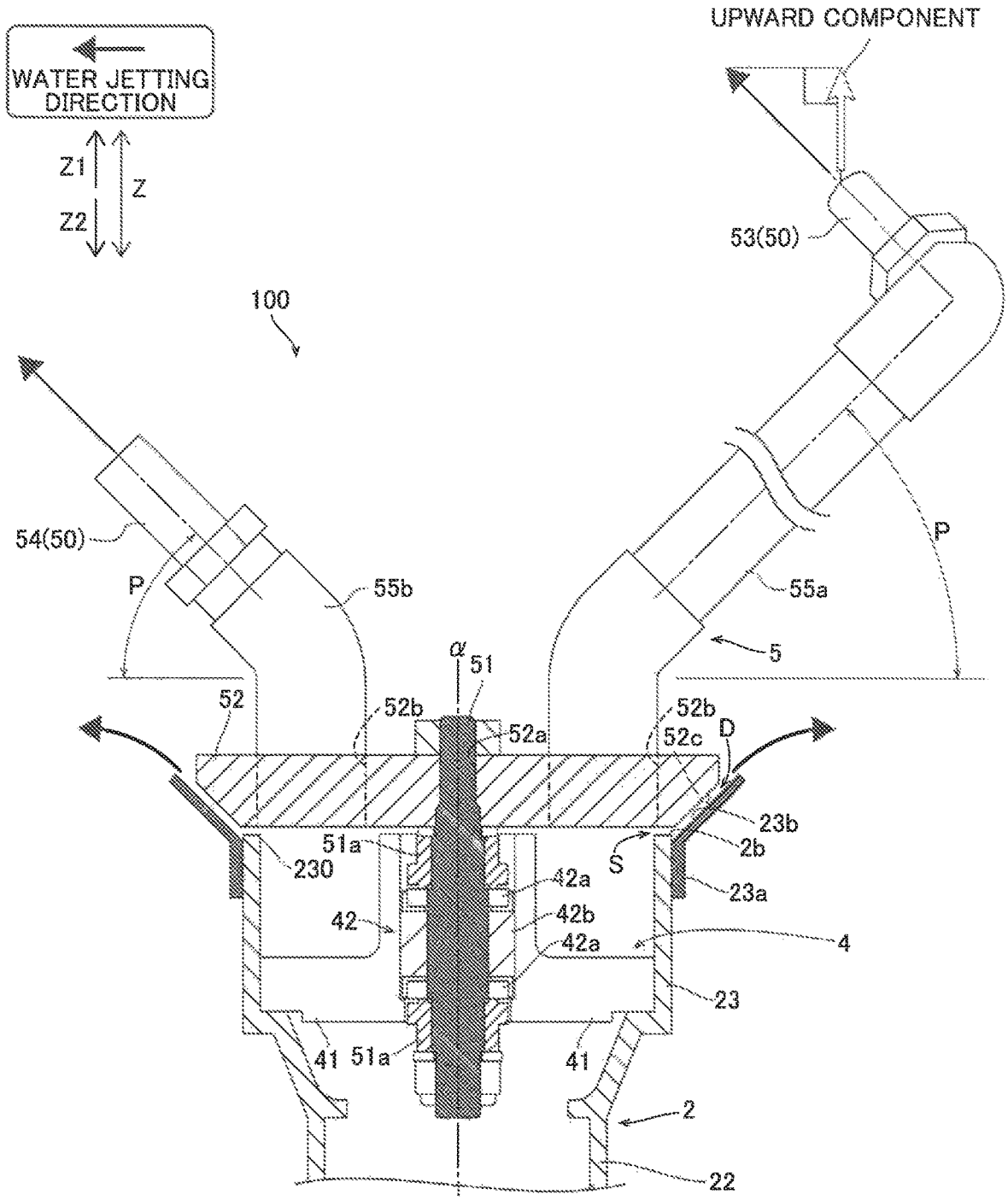
FIG. 3 A sectional view taken along the line 500-500 in FIG. 2.

As shown in FIG. 3, the support mechanism 4 is provided at the other end 2*b* of the water supply pipe 2. The support mechanism 4 rotatably supports the rotating mechanism 5 via the rotating shaft 51 of the rotating mechanism 5. The support mechanism 4 is disposed inside the cylindrical side wall 23 of the water supply pipe 2.

The support mechanism 4 includes holders (ribs) 41 and a support mechanism main body 42.

The holders 41 hold the support mechanism main body 42 in a state in which the support mechanism main body 42 is disposed at the center inside the annular side wall 23. A plurality of holders 41 are aligned in the circumferential direction of the rotating shaft 51. Each of the plurality of holders 41 extends radially in the radial direction of the rotating shaft 51 of the rotating mechanism 5. The outer ends of the holders 41 are connected to the side wall 23 of the water supply pipe 2. The inner ends of the holders 41 are connected to the support mechanism main body 42, and hold the support mechanism main body 42. The thicknesses of the holders 41 in the circumferential direction of the rotating shaft 51 of the rotating mechanism 5 are thinner such that the flow of water inside the side wall 23 is less likely to be obstructed.

The support mechanism main body 42 rotatably supports the rotating shaft 51 of the rotating mechanism 5. Specifically, the support mechanism main body 42 includes a pair of fixed-side bearings 42*a* configured to support the rotating shaft 51 and spaced apart from each other in the Z direction, and a cylindrical spacer 42*b* disposed between the pair of fixed-side bearings 42*a*.

<Structure of Rotating Mechanism>

As shown in FIG. 3, the rotating mechanism 5 includes the rotating shaft 51, the rotating member 52, water jet nozzles 50 including the first jet nozzles 53 and second jet nozzles 54, a plurality of pipes 55*a* including tips at which the first jet nozzles 53 are provided one by one, and a plurality of pipes 55*b* including tips at which the second jet nozzles 54 are provided one by one. The plurality of pipes 55*a* and the plurality of pipes 55*b* are fixed (attached) to the rotating member 52 from above.

The rotating shaft 51 includes a pair of rotating-side bearings 51*a* configured to sandwich the pair of fixed-side bearings 42*a* from above and below. The rotating-side bearings 51*a* rotate together with the rotating shaft 51, and slide while contacting the horizontal surfaces of the fixed-side bearings 42*a* and supporting a (thrust) load generated in an upward-downward direction around the rotating shaft 51. The sliding surfaces of the fixed-side bearings 42*a* and the rotating-side bearings 51*a* are lubricated by water.

The rotating shaft 51 generally has a cylindrical shape that extends in the Z direction. The rotation center axis a of the rotating shaft 51 substantially coincides with the center position of the second pipe 22 of the water supply pipe 2 that extends in the Z direction. In addition, the rotation center axis a of the rotating shaft 51 is generally located between the center axis 13 of a portion of the first pipe 21 that extends in the upward-downward direction and the rotation center axis y of the pump rotating shaft 11*a* of the submersible pump 1 in a horizontal direction.

The rotating member 52 has a disk shape that is circular in a plan view (as viewed in the Z direction). The rotating member 52 includes a through-hole 52*a* and a plurality of (four) through-holes 52*b*.

The through-hole 52*a* passes through the rotating member 52 in the Z direction. The through-hole 52*a* is disposed at the center position of the rotating member 52. The rotating shaft 51 is inserted through the through-hole 52*a* such that the rotating member 52 is fixed, and the rotating member 52 is attached to the rotating shaft 51 so as to rotate together with the rotating shaft 51. Furthermore, the pipes 55*a* and the pipes 55*b* are connected to the rotating member 52, and the rotating member 52 rotates together with the rotating shaft 51.

Each of the plurality of (four) through-holes 52*b* passes through the rotating member 52 in the Z direction. The plurality of through-holes 52*b* are arranged at substantially equal angular intervals (90 degrees) in the circumferential direction of the rotating shaft 51.

The pipes 55*a* are fixed to some (two) of the plurality of (four) through-holes 52*b*. Furthermore, the pipes 55*b* are fixed to the others (two) of the plurality of (four) through-holes 52*b*. The upstream ends (ends on the rotating member 52 side) of the pipes 55*a* and the pipes 55*b* are connected to an internal space of the water supply pipe 2 such that water can be received from the water supply pipe 2. Both the pipes 55*a* and the pipes 55*b* extend in the radial direction of the rotating shaft 51 in the plan view (see FIG. 2). Both the pipes 55*a* and the pipes 55*b* extend obliquely upward in a side view. For example, both the pipes 55*a* and the pipes 55*b* extend obliquely upward at an angle P of 45 degrees with respect to a horizontal plane in the side view.

As described above, the plurality of (two) pipes 55*a* are provided, and a plurality of (two) first jet nozzles 53 are provided. The pipes 55*a* (the plurality of first jet nozzles 53 respectively provided at the tips of the plurality of pipes 55*a*) are arranged at substantially equal angular intervals (180 degrees) in the circumferential direction of the rotating shaft 51.

As described above, the plurality of (two) pipes 55*b* are provided, and a plurality of (two) second jet nozzles 54 are provided. The plurality of pipes 55*b* (the plurality of second jet nozzles 54 respectively provided at the tips of the plurality of pipes 55*b*) are arranged at substantially equal angular intervals (180 degrees) in the circumferential direction of the rotating shaft 51. Furthermore, the plurality of pipes 55*b* are provided at substantially intermediate angular positions between the pipes 55*a* in the circumferential direction of the rotating shaft 51.

The first jet nozzles 53 are configured to jet water supplied from the submersible pump 1 through the water supply pipe 2. The first jet nozzles 53 are configured to jet the water in the jetting direction having the propulsive force component in the circumferential direction (tangential direction) of a rotating shaft 51. In FIG. 2, a circular line along the circumferential direction of the rotating shaft 51 centered on the rotation center axis a and using a distance from the rotation center axis a to each of bases of the first jet nozzles 53 and the second jet nozzles 54 (a distance between the rotation center axis a and each of bent portions of elbows of the pipes 55*a* provided with the first jet nozzles 53) as its radius is shown by a broken line L1. The pipes 55*a* extend along a direction in which a normal L2 of the broken line L1 extends in the plan view. The propulsive force component in the circumferential direction (tangential direction) of the rotating shaft 51 refers to a component directed in a direction in which a tangent L3 of the circular broken line L1 extends in the plan view.

If the first jet nozzles 53 jet water along the normal L2 in the plan view, the jetted water does not have the propulsive force component in the circumferential direction (tangential direction) of the rotating shaft 51, and thus the rotating mechanism 5 does not rotate. Therefore, the first jet nozzles 53 are configured to jet water in a direction inclined by an acute angle A1 with respect to the normal L2 in the plan view. The first jet nozzles 53 jet water toward the inner side of the circular broken line L1.

As shown in FIG. 2, the rotation direction of the pump rotating shaft 11*a* (impeller 12) in the plan view is clockwise, but a reaction force generated thereby causes the motor 11 to rotate counterclockwise. Thus, there is a possibility that the submersible pump 1 moves in the water storage area H. Therefore, the first jet nozzles 53 are configured to jet water in the direction inclined at the acute angle A1 with respect to the normal L2 in the plan view such that it is possible to counteract the force that causes the motor 11 to rotate counterclockwise, and it is possible to prevent movement of the submersible pump 1 in the water storage area H during operation.

As shown in FIG. 3, the first jet nozzles 53 are configured to jet water in a jetting direction having an upward component. That is, the first jet nozzles 53 are configured to jet water upward not downward. Similarly, the second jet nozzles 54 are configured to jet water in a jetting direction having an upward component.

As shown in FIG. 2, the second jet nozzles 54 are configured to jet the water supplied from the submersible pump 1 through the water supply pipe 2. The pipes 55*b* extend along a direction in which a normal L4 of the broken line L1 extends in the plan view. The second jet nozzles 54 are configured to jet water in a jetting direction having no propulsive force component in the circumferential direction (tangential direction) of the rotating shaft 51. That is, the second jet nozzles 54 are configured to jet water in an outward direction (outward in the radial direction of the rotating shaft 51) along the normal L4 in the plan view. Thus, the planar discharge angles of the second jet nozzles 54 are set to the normal L4 such that the reach and height of the water jetted from the second jet nozzles 54 can be maximized without offsetting jets from the second jet nozzles 54 by the propulsive force component in the circumferential direction (tangential direction) of the rotating shaft 51 generated by jets from the first jet nozzles 53.

As shown in FIG. 3, the gap S is provided between the water supply pipe 2 (the upper end of the side wall 23) and the rotating mechanism 5 (rotating member 52) as described above. In the fountain apparatus 100, water is jetted from the gap S.

The side wall 23 includes a water guide jet 23*a* on its outer peripheral side. The water guide jet 23*a* surrounds the periphery of the rotating member 52, and is configured to guide water that has passed through the gap S obliquely upward and jet the same. The water guide jet 23*a* has a funnel shape that widens upward. That is, the fountain apparatus 100 is configured to jet water from the gap S via the water guide jet 23*a* in addition to the first jet nozzles 53 and the second jet nozzles 54.

The rotating member 52 includes an inclined surface 52*c* that faces the inner surface 23*b* of the water guide jet 23*a*. Between the inner surface 23*b* of the funnel-shaped water guide jet 23*a* and the inclined surface 52*c*, a water guide channel D that guides the water that has passed through the gap S is formed. In a direction in which the water guide channel D extends (a direction from the upstream side toward the downstream side), the width (an interval between the inner surface 23*b* and the inclined surface 52*c*) of the water guide channel D is substantially constant. The fountain apparatus 100 is configured to jet the water that has passed through the annular gap S in an annular shape and a dish shape (dish edge shape) via the funnel-shaped water guide jet 23*a* and the water guide channel D.

Advantageous Effects of this Embodiment

According to this embodiment, the following advantageous effects are achieved.

According to this embodiment, as described above, the first jet nozzles 53 jets the water in the jetting direction having the propulsive force component in the circumferential direction of the rotating shaft 51 such that a rotational force can be applied to the rotating mechanism 5. That is, water can be jetted while the rotating mechanism 5 is rotated without providing a dedicated drive mechanism for rotating the rotating mechanism 5 in addition to the submersible pump 1 that supplies water to the rotating mechanism 5 in the fountain apparatus 100. Therefore, it is not necessary to provide a motor and a plurality of gears as a drive that rotates the rotating mechanism 5 as in the prior art, and thus an increase in the number of components can be significantly reduced or prevented. Consequently, an increase in the size of the apparatus can be significantly reduced or prevented, and the complicated apparatus structure can be significantly reduced or prevented.

According to this embodiment, as described above, the plurality of first jet nozzles 53 are provided, and the plurality of first jet nozzles 53 are arranged at the substantially equal angular intervals in the circumferential direction of the rotating shaft 51. Accordingly, a rotational force can be applied to the rotating mechanism 5 in a balanced manner by the plurality of first jet nozzles 53, and thus the rotating mechanism 5 can be stably rotated.

According to this embodiment, as described above, the second jet nozzles 54 are further provided to jet water in the jetting direction having no propulsive force component in the circumferential direction of the rotating shaft 51. Accordingly, water can be jetted in the different jetting direction from that of the first jet nozzles 53 by the second jet nozzles 54, and thus water can be jetted in more various directions, unlike the case in which water is jetted only from the first jet nozzles 53. That is, the shape of the jetted water can be changed from a monotonous shape to a more complicated shape. Consequently, when the fountain apparatus 100 is used for ornamental purposes, a preferable water shape can be obtained for ornamental purposes. In addition, the second jet nozzles 54 are provided separately from the first jet nozzles 53 that jet the water having the propulsive force component in the circumferential direction of the rotating shaft 51 such that water can be jetted in various directions while an excessive increase in a rotational force acting on the rotating mechanism 5 is significantly reduced or prevented.

According to this embodiment, as described above, the float 3 that surrounds the water supply pipe 2 is further provided. Accordingly, unlike the case in which the fountain apparatus 100 is fixed to the bottom surface of a place in which water is stored, the fountain apparatus 100 can be easily installed at a predetermined height position with respect to the water surface by the float 3. Moreover, the fountain apparatus 100 can be easily installed in various places in which water is stored.

According to this embodiment, as described above, the submersible pump 1 is disposed on the rotation center axis a of the rotating shaft 51. Accordingly, the position of the center of gravity of the submersible pump 1 having a relatively heavy weight can be located directly below the float 3, and thus the submersible pump 1 can be stably supported by the float 3. Consequently, tilting of the fountain apparatus 100 floated by the float 3 can be significantly reduced or prevented.

According to this embodiment, as described above, the first jet nozzles 53 are inclined at an angle of less than 180 degrees with respect to the normal of the circle that extends in the circumferential direction of the rotating shaft 51 in the plan view. According to this structure, even when the motor 11 rotates in a direction opposite to that of the rotating shaft 51 due to a reaction force generated by rotation of the pump rotating shaft 11*a* (impeller 12), a propulsive force can be applied by rotating the rotating mechanism 5 in a direction to counteract the force generated by rotation of the motor 11. Thus, movement of the submersible pump 1 (fountain apparatus 100) due to the force generated by rotation of the motor 11 can be prevented, and the flying shape of the water jetted from the first jet nozzles 53 can be unique with a stronger twist.

According to this embodiment, as described above, the gap S is provided between the water supply pipe 2 and the rotating mechanism 5, and water is jetted from the gap S. Accordingly, it is not necessary to provide a seal member generally provided between the water supply pipe 2 and the rotating mechanism 5, and thus the complicated apparatus structure can be further significantly reduced or prevented. Furthermore, there is no mechanical sliding, and thus stable rotation can be maintained as compared with the case in which a seal member or the like is provided. Moreover, water can be jetted in the different jetting direction from that of the first jet nozzles 53, and thus unlike the case in which water is jetted only from the first jet nozzles 53, water can be jetted in more various directions. Consequently, when the fountain apparatus 100 is used for ornamental purposes, a preferable water shape can be obtained for ornamental purposes.

According to this embodiment, as described above, the rotating mechanism 5 further includes the pipes 55*a* and 55*b* including the tips at which the water jet nozzles 50 are provided, and the rotating member 52 connected to the pipes 55*a* and 55*b* and configured to rotate together with the rotating shaft 51. Furthermore, the water supply pipe 2 includes the annular side wall 23 including the opening 230 on the upper side, and the side wall 23 is disposed below the rotating member 52 such that the opening 230 is substantially covered by the rotating member 52, and includes the upper end spaced apart from the rotating member 52 by the annular gap S. Accordingly, the water jetted from the annular gap S can be jetted annularly and substantially evenly in the circumferential direction of the rotating shaft 51.

According to this embodiment, as described above, the first jet nozzles 53 are configured to jet water in the jetting direction having the upward component. Accordingly, interference of the water jetted from between the water supply pipe 2 and the rotating mechanism 5 with the first jet nozzles 53 can be prevented. Moreover, water can be jetted upward from the first jet nozzles 53, and thus the jetted water can be more easily visually recognized and can reach a wider range.

According to this embodiment, as described above, the side wall 23 includes the funnel-shaped water guide jet 23*a* that surrounds the periphery of the rotating member 52 and that guides the water that has passed through the gap S obliquely upward and jets the same. Accordingly, the funnel-shaped water guide jet 23*a* can adjust the flow direction of the water that passes therethrough, and thus the jetting direction of the water to be jetted can be adjusted.

According to this embodiment, as described above, the rotating member 52 includes the inclined surface 52*c* that faces the inner surface 23*b* of the funnel-shaped water guide jet 23*a*, and the water guide channel D that guides the water that has passed through the gap S is formed between the inner surface 23*b* of the funnel-shaped water guide jet 23*a* and the inclined surface 52*c*. Accordingly, the water guide channel D can further adjust the flow direction of the water that passes therethrough, and thus the jetting direction of the water to be jetted can be further adjusted. Consequently, the shape of the water jetted through the water guide channel D can be generally made into a dish shape (dish edge shape).

Modified Examples

The embodiment disclosed this time must be considered as illustrative in all points and not restrictive. The scope of the present invention is not shown by the above description of the embodiment but by the scope of claims for patent, and all modifications (modified examples) within the meaning and scope equivalent to the scope of claims for patent are further included.

For example, while the example in which the fountain apparatus includes the float has been shown in the aforementioned embodiment, the present invention is not restricted to this. In the present invention, instead of providing the float in the fountain apparatus, the fountain apparatus may be fixed to the bottom surface of the water storage area, for example.

While the example in which the fountain apparatus includes both the first jet nozzles and the second jet nozzles has been shown in the aforementioned embodiment, the present invention is not restricted to this. In the present invention, the fountain apparatus may include only the first jet nozzles and may not include the second jet nozzles.

While the example in which water is jetted outward in the radial direction of the rotating shaft from the second jet nozzles has been shown in the aforementioned embodiment, the present invention is not restricted to this. In the present invention, for example, water may be jetted inward in the radial direction of the rotating shaft from the second jet nozzles.

The jetting direction of the first jet nozzles according to the present invention is not limited to the water jetting direction of the first jet nozzles shown in the embodiment described above, but water may be jetted in any direction from the first jet nozzles as long as the jetting direction of the first jet nozzles according to the present invention has the propulsive force component in the circumferential direction of the rotating shaft.

While the example in which the two first jet nozzles are provided has been shown in the aforementioned embodiment, the present invention is not restricted to this. In the present invention, one or three or more first jet nozzles may be provided.

While the example in which the two second jet nozzles are provided has been shown in the aforementioned embodiment, the present invention is not restricted to this. In the present invention, one or three or more second jet nozzles may be provided.

While the example in which the fountain apparatus includes equal numbers of first jet nozzles and second jet nozzles has been shown in the aforementioned embodiment, the present invention is not restricted to this. In the present invention, for example, the fountain apparatus may include different numbers of first jet nozzles and second jet nozzles, such as four first jet nozzles and two second jet nozzles.

While the example in which the submersible pump is disposed on the rotation center axis of the rotating shaft of the rotating mechanism has been shown in the aforementioned embodiment, the present invention is not restricted to this. In the present invention, the submersible pump may be disposed at a position deviated from the rotation center axis of the rotating shaft.

The invention claimed is:

1. A fountain apparatus comprising:
- a submersible pump (1);
- a water supply pipe (2) including one end connected to a discharge port (13*b*) of the submersible pump;
- a rotating mechanism (5) including a rotating shaft (51) and a water jet nozzle (50) configured to jet water supplied through the water supply pipe; and
- a support mechanism (4) provided at another end of the water supply pipe and configured to rotatably support the rotating mechanism via the rotating shaft; and
- a float (3), wherein
- the water jet nozzle (50) includes a first jet nozzle (53) configured to jet water in a jetting direction having a propulsive force component in a circumferential direction of the rotating shaft,
- the float is buoyant such that the float floats on water while supporting the submersible pump at a predetermined depth below a surface of the water, and
- the float surrounds a portion of the water supply pipe at the surface of the water.

2. The fountain apparatus according to claim 1, wherein
- the first jet nozzle (53) includes a plurality of first jet nozzles; and
- the plurality of first jet nozzles are arranged at substantially equal angular intervals in the circumferential direction of the rotating shaft.

3. The fountain apparatus according to claim 1, wherein the water jet nozzle (50) further includes a second jet nozzle (54) configured to jet the water in a jetting direction having no propulsive force component in the circumferential direction of the rotating shaft.

4. The fountain apparatus according to claim 1, wherein the submersible pump (1) is disposed on a rotation center axis of the rotating shaft.

5. The fountain apparatus according to claim 1, wherein the first jet nozzle (50) is inclined at an angle of less than 180 degrees with respect to a normal of a circle that extends in the circumferential direction of the rotating shaft in a plan view.

6. The fountain apparatus according to claim 1, wherein
- a gap (S) is provided between the water supply pipe and the rotating mechanism; and
- the water is jetted from the gap.

7. The fountain apparatus according to claim 6, wherein
- the rotating mechanism further includes a pipe (55*a*, 55*b*) including a tip at which the water jet nozzle is provided, and a rotating member (52) connected to the pipe and configured to rotate together with the rotating shaft;
- the water supply pipe includes an annular side wall (23) including an opening on an upper side; and
- the side wall is disposed below the rotating member such that the opening is substantially covered by the rotating member, and includes an upper end spaced apart from the rotating member by the gap that is annular.

8. The fountain apparatus according to claim 7, wherein the side wall includes a funnel-shaped water guide jet (23*a*) that surrounds a periphery of the rotating member, the funnel-shaped water guide jet being configured to guide water that has passed through the gap obliquely upward and jet the water.

9. The fountain apparatus according to claim 8, wherein the rotating member includes an inclined surface (52*c*) that faces an inner surface of the funnel-shaped water guide jet; and a water guide channel (D) configured to guide the water that has passed through the gap is formed between the inner surface of the funnel-shaped water guide jet and the inclined surface.

10. The fountain apparatus according to claim 1, wherein the first jet nozzle is configured to jet the water in a jetting direction having an upward component.

* * * * *